US008968113B2

(12) United States Patent
Spelman et al.

(10) Patent No.: US 8,968,113 B2
(45) Date of Patent: Mar. 3, 2015

(54) GOLF PUTTING TRAINER DEVICE

(71) Applicants: John R Spelman, Glen Arm, MD (US); Trevor Alan Wade, Bel Air, MD (US)

(72) Inventors: John R Spelman, Glen Arm, MD (US); Trevor Alan Wade, Bel Air, MD (US)

( * ) Notice: Subject to any disclaimer, the term of this patent is extended or adjusted under 35 U.S.C. 154(b) by 0 days.

(21) Appl. No.: 14/085,204

(22) Filed: Nov. 20, 2013

(65) Prior Publication Data

US 2014/0155187 A1 Jun. 5, 2014

Related U.S. Application Data

(60) Provisional application No. 61/731,499, filed on Nov. 30, 2012, provisional application No. 61/808,011, filed on Apr. 3, 2013.

(51) Int. Cl.

| | |
|---|---|
| ***A63B 69/36*** | (2006.01) |
| *A63B 24/00* | (2006.01) |
| *A63B 71/02* | (2006.01) |
| *A63B 71/06* | (2006.01) |

(52) U.S. Cl.

CPC ..... *A63B 69/3676* (2013.01); *A63B 69/3641* (2013.01); *A63B 24/0003* (2013.01); *A63B 2071/024* (2013.01); *A63B 2071/0625* (2013.01); *A63B 2071/0694* (2013.01); *A63B 2207/02* (2013.01); *A63B 2210/50* (2013.01); *A63B 2220/20* (2013.01); *A63B 2220/803* (2013.01); *A63B 2225/09* (2013.01)

USPC ..... 473/220

(58) Field of Classification Search

USPC ..... 473/150, 151, 220–222, 224, 225, 473/261–268, 278, 279

See application file for complete search history.

(56) References Cited

U.S. PATENT DOCUMENTS

| | | | | | |
|---|---|---|---|---|---|
| 3,009,704 | A | * | 11/1961 | Heard | 473/151 |
| 3,860,247 | A | * | 1/1975 | Taylor | 473/218 |
| 4,153,255 | A | | 5/1979 | Woodson | |
| 4,540,179 | A | | 9/1985 | Slagle | |
| 4,786,057 | A | * | 11/1988 | Brown | 473/265 |
| 4,900,030 | A | | 2/1990 | Houtz | |
| 4,927,153 | A | | 5/1990 | Schaefer | |
| 5,042,814 | A | * | 8/1991 | Bennett | 473/225 |
| 5,409,231 | A | * | 4/1995 | Kueng et al. | 473/261 |

(Continued)

FOREIGN PATENT DOCUMENTS

| | | |
|---|---|---|
| FR | 2959136 | 3/2012 |
| KR | 1020070064698 | 6/2007 |

OTHER PUBLICATIONS

EyeLine Golf—Putting Laser+. Retrieved Sep. 12, 2012, from http://www.eyelinegolf.com/collections/putting-aids/products/putting-laser.

(Continued)

*Primary Examiner* — Nini Legesse

(74) *Attorney, Agent, or Firm* — Whiteford, Taylor & Preston, LLP; Gregory M. Stone

(57) ABSTRACT

A device for assisting and training golfers with their putts. The device includes an elongated section configured to be placed on the ground where the golfer intends to make his backswing for a selected put. A vertical section or "backstop" is configured to be placed at selected locations along the elongated section to corresponding to different putt lengths, and therefore different backswing lengths. A distance scale may be printed on the elongated section. Light projection devices may be included to project a predicted ball path. A backswing speed indicator system may also be included.

24 Claims, 8 Drawing Sheets

(56) References Cited

U.S. PATENT DOCUMENTS

| | | | | |
|---|---|---|---|---|
| 5,501,452 | A * | 3/1996 | Halvorson | 473/260 |
| 6,579,191 | B1 | 6/2003 | Hambly | |
| 6,702,690 | B1 * | 3/2004 | Albright | 473/265 |
| 6,840,870 | B1 * | 1/2005 | Froggatte | 473/265 |
| 6,997,817 | B1 | 2/2006 | Consiglio | |
| 7,938,732 | B2 | 5/2011 | Kuhlman, Jr. et al. | |
| 8,002,643 | B2 | 8/2011 | Bittner | |
| 8,177,656 | B2 | 5/2012 | Bittner | |
| 2008/0207347 | A1 | 8/2008 | Rose | |

OTHER PUBLICATIONS

Green Laser Putting Aid. Retrieved Sep. 12, 2012, from http://thelaserguy.stores.yahoo.net/ergrlapiaid.html.

Laser T Golf Training Aid. Retrieved Sep. 12, 2012, from http://www.intheholegolf.com/Merchant2.merchant.mvc?Screen=PROD&Store_Code=IT . . . .

Putting Map. Retrieved Sep. 12, 2012, from http://www.yaosgolf.com/HTM/Puttingmap2048.htm.

Laser Putting System. Retrieved Sep. 12, 2012, from http://www.amazon.com/Laser-Putting-System/dp/B000VZKKAY/ref=sr_1_9?s=sporting- . . . .

Golf Putting Laser Guided Trainer + Digital Swing Analysis System. Retrieved Sep. 12, 2012, from http://www.amazon.com/Golf-Putting-Laser-Trainer-Analysis/dp/B005FG5OP0/ref=s_1_. . . .

EyeLine Gold Spot on Laser. Retrieved Sep. 12, 2012, from http://www.amazon.com/EyeLine-Golf-Spot-On-Laser/dpB004S66EN4/ref=sr_1_4?s=spo . . . .

* cited by examiner

GOLF PUTTING TRAINER DEVICE

CROSS-REFERENCES TO RELATED APPLICATIONS

This application claims the priority benefit under 35 U.S.C. §119(e) of U.S. Provisional Application Ser. No. 61/731,499, entitled "GOLF PUTTING TRAINER DEVICE," filed Nov. 30, 2012, and U.S. Provisional Application Ser. No. 61/808,011, entitled "GOLF PUTTING TRAINER DEVICE," filed Apr. 3, 2013, both of which are incorporated herein by reference in their entirety.

BACKGROUND OF THE INVENTION

1. Field of the Invention

This invention relates generally to golf training devices, and more particularly to a golf putting trainer device configured to provide a golfer with a consistent putting stroke of proper form.

2. Background of the Prior Art

Golf is a sport that has enjoyed popularity and garnered enthusiasts for hundreds of years. Throughout the history of the game, golfers have continuously strived to improve their game. Moreover, a critical part of the game, and a major contributor to a golfer's score in any game, is putting—typically the final strokes the golfer takes to sink their ball into the hole. The development of a consistent putting stroke of proper form is thus essential to the typical golfer's goal of lowering their score.

Mastering the art of putting, however, requires regular practice. Moreover, practicing a putting stroke that is not of proper form can produce a consistently poor stroke, which is obviously counter to the typical golfer's goals. Thus, it is important that as a golfer is practicing their swing, they are practicing a swing of proper form, and are provided feedback throughout that practice on whether or not they are practicing such proper form.

More particularly, in order to produce a proper putting stroke, a golfer should follow the basic mechanical tenets of (i) keeping their eyes over the ball, (ii) having proper alignment of the putter face to the target (i.e., the hole), (iii) applying topspin to the ball to enhance distance control and maintenance of the putting line, (iv) keeping their backstroke in alignment with a center line, and (iv) an accelerating stroke for consistency and distance control. Likewise, in order to produce a proper putting stroke, a golfer should also follow the basic subjective tenets of (i) developing a "feel", or instinctive ability, and (ii) developing the ability to visualize the proper putting line. Feel for distance is especially important when putting to a "breaking hole." If the putt is too fast, it will not have enough break, and if it is too slow, it will have too much break, often missing the putt as a result. Last, it is important that the golfer have confidence in his line and his ability to read the green, and thus must practice on a variety of holes of varied geometries having various degrees and direction of break to properly develop the "feel" necessary to properly read the greens.

Thus, in order for a golfer to improve their putting game, it is important to apply the basic mechanics and to develop a proper "feel" and ability to visualize their putt. The development of these skills requires controlled practice, where that controlled practice exemplifies a putt of proper form.

While numerous golf aids have been provided in the past, there remains a need in the art for a putting trainer device that can aid a golfer in the development of a proper putting stroke through practice of a putting stroke of proper form, and that provides feedback to the golfer that they are in fact practicing proper form. Such a device should have a visual aid that helps the golfer to develop proper visualization of their putt, and should provide a physical aid that ensures that the golfer maintain proper form (including initial alignment, maintaining such alignment through the backswing, and applying topspin to the ball) throughout the putting stroke.

SUMMARY OF THE INVENTION

Disclosed is a golf putting trainer device that is configured to provide an intuitive coaching system to aid a golfer in the development of proper visualization of their putt, and that provides a physical aid that ensures that the golfer maintain proper form (including through ensuring proper alignment, proper backswing, and proper topspin application) throughout their practice putting strokes. The putting trainer device includes a backstop that limits the putter's backstroke and that may vary its position based upon a distance of the putter's ball from the hole. The putting trainer device also includes a light beam projection device configured to project a tracking pathway onto the ground in front of the putting trainer device, indicating the ball path that the putter should strive to putt the ball through with their stroke. Such configuration is designed to increase a golfer's comfort on the green with a simple yet high-tech method.

DETAILED DESCRIPTION OF THE INVENTION

The following description is of particular embodiments of the invention, set out to enable one to practice various implementations of the invention, and is not intended to limit the invention to the preferred embodiments, but to serve as particular examples thereof. Those skilled in the art should appreciate that they may readily use the conception and specific embodiments disclosed as a basis for modifying or designing other methods and systems for carrying out the same purposes of the present invention. Those skilled in the art should also realize that such equivalent assemblies do not depart from the spirit and scope of the invention in its broadest form.

Figure 1:
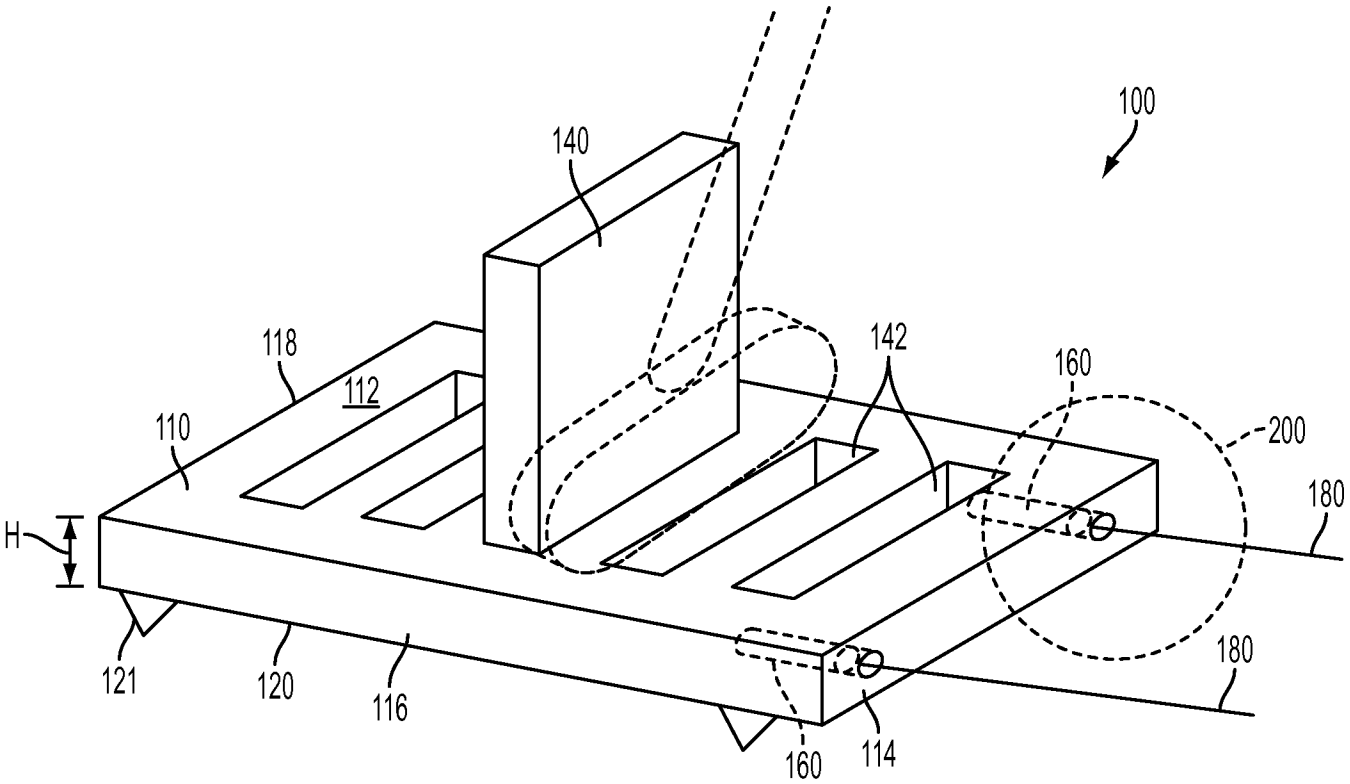
FIG. 1 is a perspective illustration of a golf putting trainer according to an embodiment of the invention.

First, with reference to the side perspective view of FIG. 1, a golf putting trainer device (shown generally at 100) is provided having a base 110 that is generally in the form of an elongate rectangle. Base 110 has a thickness dimension H, a top face 112, a front edge 114, side edges 116, a back edge 118, and a bottom face 120. Top face 112 is preferably flat. Thickness dimension H is preferably in the range of ½" to ⅝", such that when base 110 is resting on a surface with a golf ball 200 (shown in phantom in FIG. 1) placed in close proximity to the front edge 114 (the specific location varying with the individual golfer's comfort zone), a putter that is swung towards the ball as it maintains contact with top face 112 will apply a proper amount of topspin to the ball.

Golf putting trainer device 100 includes a putter backstop 140 that may be positioned at varying locations along the length of putting trainer device 100. Putter backstop 140 is configured to provide physical, visual, and optionally audio feedback to the golfer to indicate the proper amount of backstroke for an intended putt distance, thus allowing the golfer to develop the skill of properly predicting the average distance a putt will travel given a backstroke length ending at the location of backstop 140 (which may vary with the speed of the greens, but will nonetheless provide a good bench mark for distance control). Putter backstop 140 may, as shown in the exemplary embodiment of FIG. 1, comprise a block that may be variably positioned along top face 112 of base 110, particularly by placing backstop 140 in one of a plurality of backstop receivers, such as slots 142 that run perpendicular to the length of base 110, and that extend into base 110 a sufficient depth so as to hold putter backstop 140 in place. Slots 142 are preferably spaced apart at such a distance so as to allow the backstop 140 to be placed at graduated distances from the ball, and more particularly are preferably positioned so as to cause a golfer's putter to stop during their backswing at any one of a number of distances from ball 200, which distances are particularly suited to ensure that the golfer strikes ball 200 with enough force to ensure that it travels the intended distance to the hole. Depending upon the force with which a particular golfer typically swings their putter club, a golfer will, through practice using putting trainer device 100, develop their own scheme for placement of backstop 140 in a particular slot 142 for a given distance of the ball 200 from the hole.

Figure 2:
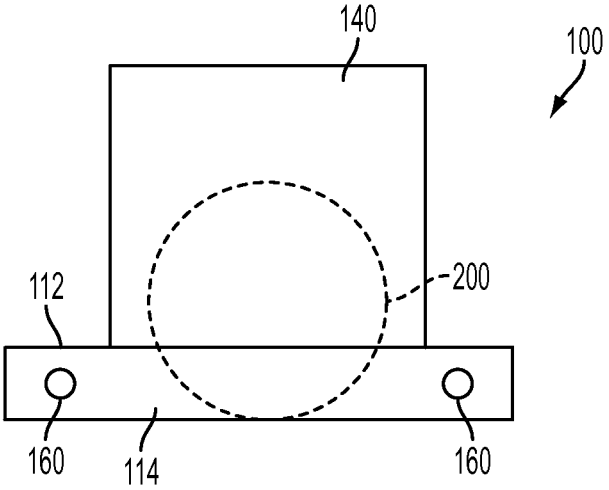
FIG. 2 is an end view of a golf putting trainer according to the embodiment shown in FIG. 1.

FIG. 2 provides a front end view of putting trainer device 100. As shown in FIG. 2, when backstop 140 is positioned within any of slots 142, it extends upward from top face 112, and is preferably centrally positioned within the width of base 110. The position of a ball 200 with respect to putting trainer device 100 when in use is also shown in phantom.

Figure 3:
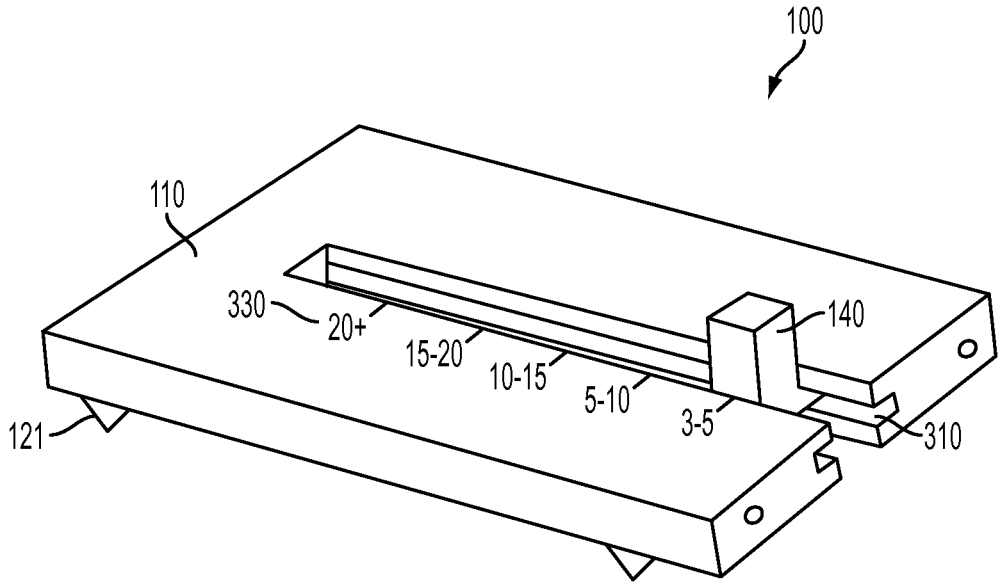
FIG. 3 is a perspective illustration of a golf putting trainer according to another embodiment of the invention.
Figure 4:
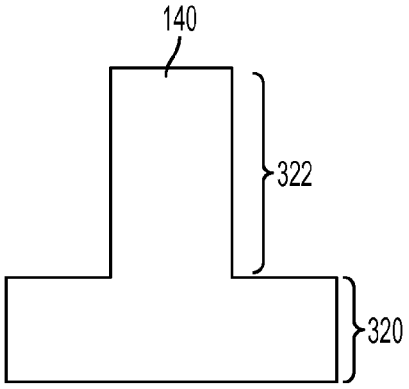
FIG. 4 is an end view illustration of a vertical backswing backstop element according to an embodiment of the invention.
Figure 5:
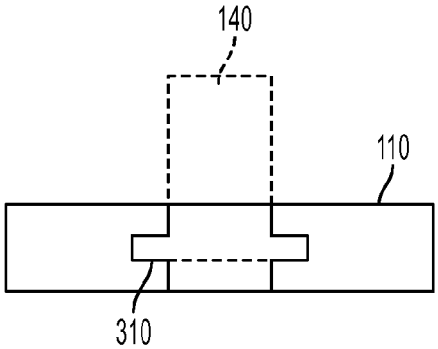
FIG. 5 is an end view illustration of an elongated base structure according to an embodiment of the invention.

Alternatively, and as shown in FIG. 3, backstop 140 may comprise a generally T-shaped block configured to slide within a groove 310 that runs centrally along the length of base 110. As shown more particularly in FIG. 4, backstop 140 may thus have a horizontal base 320 and a vertical stop member 322 that extends upward from horizontal base 320, and that is centrally positioned along horizontal base 320. Stop member 322 has a width that approximates the width of an upper portion of groove 310 in base 110 so as to provide a tight fit (sufficient to hold backstop 140 in place), but providing sufficient clearance so as to allow a golfer to intentionally change the position of backstop 140 within groove 310 without excessive effort. Similarly, horizontal base 320 has a width dimension that approximates the width of a lower portion of groove 310. As shown in the side perspective view of FIG. 3 and the front view of FIG. 5, backstop 140 may thus again be variably positioned along the length of base 110 by sliding it along groove 310 to a desired location that is based upon the golfer's distance from the hole. Preferably, a numeric scale may be provided on the surface of base 320, creating a reference for the golfer to relate their backswing stroke to the distance the ball will travel when struck. In some embodiments, that scale may indicate various measurements of distance from the hole, and an associated position marker indicating the intended position of backstop 140 for such distance measurement, for a typical golfer's putting stroke. In other embodiments, such scale may be a simple distance measurement from the end of base 110, or any delineation allowing the golfer to easily and repeatedly position backstop 140 at any intended position.

As best shown in FIG. 3, groove 310 may serve not only to hold and slidably position backstop 140, but may also provide a center guideline to help the golfer to maintain a straight path through their stroke as they travel from the full backstroke towards ball 200. Alternatively or in addition (and with regard to any of the embodiments described herein), a guideline may be printed extending centrally along top face 112 of base 110 to again help the golfer to maintain a straight path through their stroke.

Figure 6:
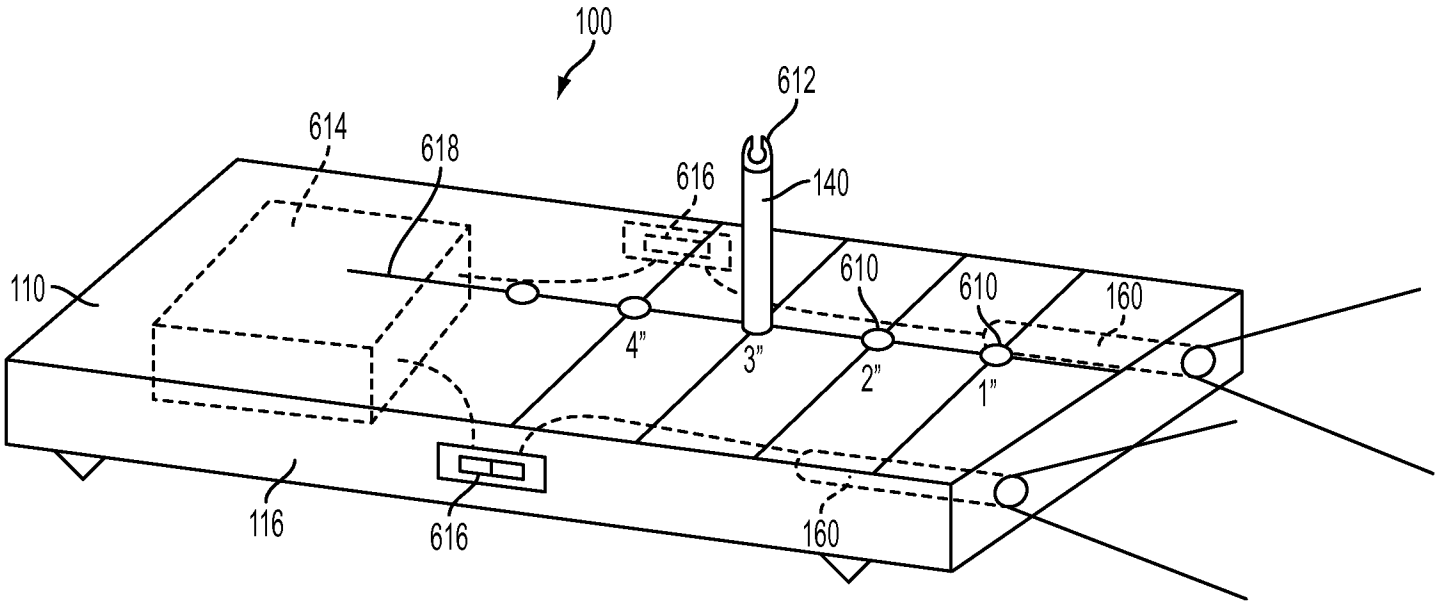
FIG. 6 is a perspective illustration of a golf putting trainer according to another embodiment of the invention.

As yet another alternative, and as shown in FIG. 6, backstop 140 may comprise a peg that may be removably placed within any of a series of peg-receiving holes 610 that are aligned along the midline of base 110, and again spaced apart at intervals to allow the golfer to modify the extent of their backswing for a given hole distance. As shown in the embodiment of FIG. 6, backstop 140 may include a bell 612 or other motion-activated sound generating device that provides audio feedback to the golfer when their putter reaches (and impacts) the rear extent of their intended backswing. Once again, base 110 may be provided a reference scale to allow the golfer to relate their backswing stroke to the distance the ball will travel when struck. Also, while only 5 holes 160 are shown in the embodiment of FIG. 6, those of ordinary skill in the art will recognize that more or fewer holes may be provided to vary the available positions for backstop 140 without departing from the spirit and scope of the invention.

Figure 7:
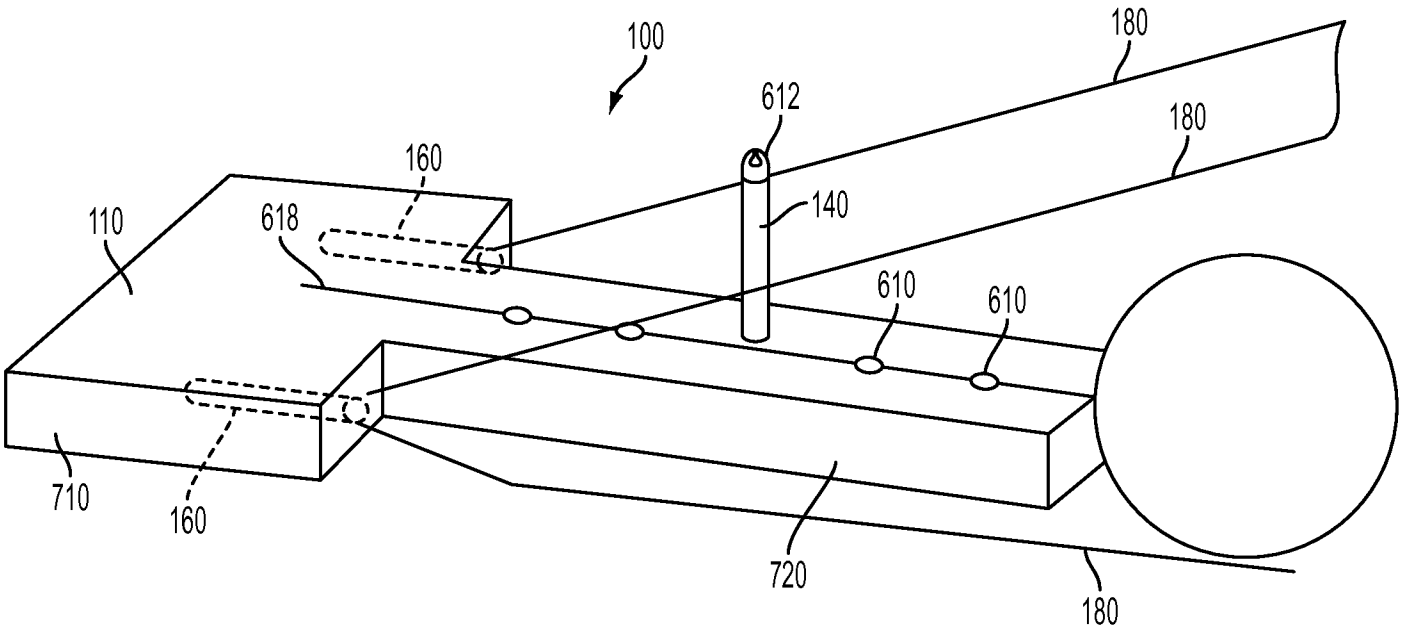
FIG. 7 is a perspective illustration of a golf putting trainer according to yet another embodiment of the invention.

In still yet another alternative, and as shown in FIG. 7, base 110 may alternatively be configured in the shape of a "T", having a wide rear portion 710 and a thinner elongate front portion 720 extending away from a front side of wide rear portion 710, with peg-receiving holes 610 being aligned along the midline of base 110, particularly along the top side of elongate front portion 720.

In addition to providing a stroke backstop and creating a vertical alignment with respect to a ball 200 to provide sufficient topspin, base 110 also includes a ball path projection device configured to project a visual representation of the intended ball path on the ground in front of putting trainer 100. In a particularly preferred embodiment, and with reference to FIGS. 1, 3, 6, and 7 (and present in each embodiment envisaged herein), such ball path projection device preferably includes two light beam projection devices 160 positioned within base 110 and aligned to project two beams of light 180 outward from base 110 and onto the ground in front of putting trainer device 100. To ensure that such beams of light 180 are visible on the ground (and do not extend outward parallel to the ground), each light beam projection device 160 is preferably comprised of a line laser configured to project a vertical line in front of base 110, which line lasers are well known to those of ordinary skill in the art and are readily commercially available. In certain embodiments of the invention, the angle of each such light beam projection device 160 with respect to base 110 may optionally be adjustable. Moreover, in particularly preferred embodiments, such light beam projection devices 160 comprise green lasers, allowing better visibility in bright sun light than, for instance, red lasers. Moreover, light projection devices 160 are preferably positioned within base 110 such that the light beams 180 that they project are spaced apart a distance that is at least equal to the width of a standard golf ball (i.e., at least 1.68"), and that is more preferably at least 1.735". Such configuration provides a visual "track" indicating the intended ball path that a ball should travel when struck using putting trainer device 100. Moreover, when comprised of line lasers that project a vertical line outward from the front of base 110, a horizontal line will appear on the ground in front of base 110, regardless of any slope present in the ground.

As particularly shown in FIG. 7, when base 110 is configured having wide rear section 710 and thinner front section 720, light projection devices 160 are preferably housed within wide rear section 710, and are spaced apart from one another by a distance that is approximately equal to a standard golf ball. In this configuration, projection lines 180 extend outward from rear section 710 of base 110, and thus provide an intended ball path track that starts along the length of front section 720 of base 110, and continues forward of base 110 to provide the intended path that a ball should travel when struck using putting trainer device 100.

In order to power light projection devices 160 (and with particular reference to FIG. 6), base 110 may be provided a power storage compartment 614 that may receive a replaceable power source, such as standard alkaline batteries. Power storage compartment 614 is in electrical communication with light projection devices 160, which are preferably wired through standard electrical switches, such as toggle switches 616, to selectively power light projection devices 160.

Figure 8A:
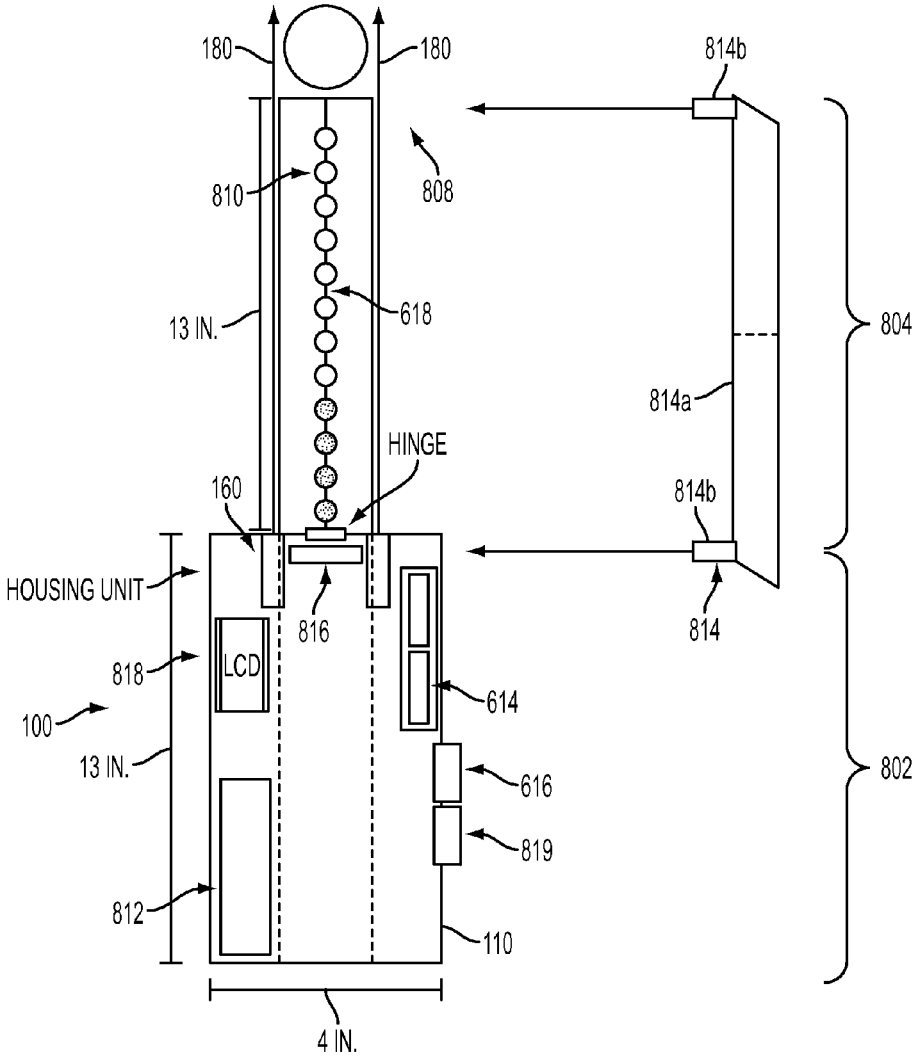
FIG. 8*a* is a top view illustration of a golf putting trainer according to a further embodiment of the invention.
Figure 8B:
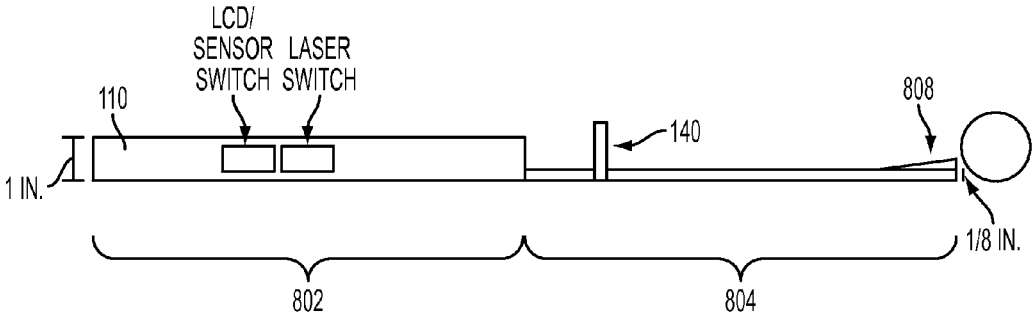
FIG. 8*b* is a side view illustration of the golf putting trainer shown in FIG. 8*a*.
Figure 8C:
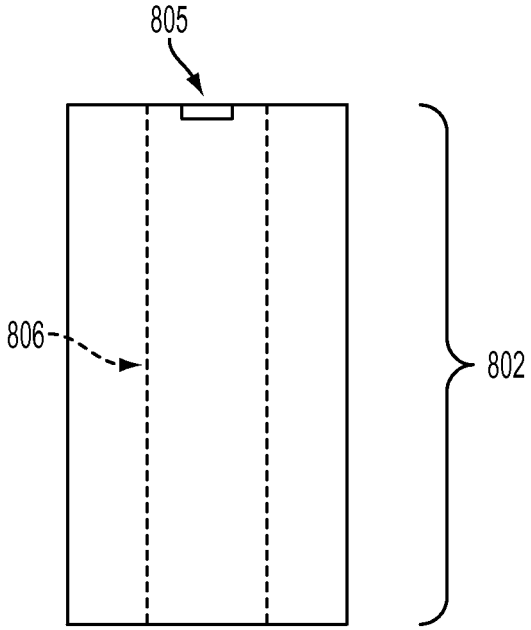
FIG. 8*c* is a bottom view illustration of the golf putting trainer shown in FIG. 8*a*.

Next, with reference to a particularly preferred embodiment of the invention, and as shown in the top view of FIG. 8*a* and the side view of FIG. 8*b*, golf putting trainer device 100 may comprise additional features configured to further assist a golfer in perfecting their putt, and that allow folding of golf putting trainer device 100 into a compact configuration so as to ensure its fit in any standard golf bag. More particularly, golf putting trainer device 100 may again include a wider rear section 802 and a thinner/narrower front section 804. Front section 804 may be hinged to rear section 802 at hinge 805 so that when not in use, front section 804 may be folded under rear section 802, thus reducing the overall length of golf putting trainer device 100 for easy storage. Optionally, and as shown in the bottom view of FIG. 8*c*, the bottom of rear section 802 may have a cut-out portion 806 configured to receive front section 804 when it is folded under rear section 802. Alternatively, the bottom face of front section 804 may rest flush against the bottom face of rear section 802 when front section 804 is folded under rear section 802. Both rear section 802 and front section 804 preferably have approximately equal length dimensions, such as (by way of non-limiting example) 13 inches.

Moreover, and with particular reference to FIG. 8*b*, front section 804 need not have the same height dimension as rear section 802. Rather, rear section 802 may have a height dimension sufficient to encompass power storage compartment 614, light beam projection devices 160, light beam projection devices toggle switch 616, and the other electronics discussed in further detail below (e.g., approximately 1 inch), while front section may have a significantly smaller height dimension (e.g., approximately ⅛ inch). In this way, a proper height dimension can be maintained in front section 804 to keep an intended vertical spacing of the golfer's putter above the ground as they move through the full stroke of their putt, without limiting the height dimension of rear section 802 (which should hold the necessary electronics for golf putting trainer device 100).

In the embodiment shown in FIGS. 8*a* and 8*b*, removable backstop 140 is provided and may be variably positioned along the length of front section 804 of golf putting trainer device 100. Backstop 140 may, for instance, have arms that wrap around the sides of front section 804 to allow backstop 140 to either be slid onto front section 804 at its end and then slid into its intended position, or be clipped on to front section 804 at its intended position. Those skilled in the art will recognize that numerous other configurations exist for removable and slidably attaching backstop 140 to the front section 804.

Additionally, a top spin platform 808 may be detachably positioned at the top side of front section 804 adjacent its free end (which free end is the end of front section 804 next to which the golfer will position their ball when using golf putting trainer device 100). As shown in FIG. 8*b*, top spin platform 808 preferably has an upward slope on its top face, which upward slope is intended to guide the user's putter vertically upward as it approaches the ball so as to impart the proper top spin on the ball upon impact. The end of top spin platform 808 that is positioned adjacent the ball is configured so that the combined height dimension of front section 804 and top spin platform 808 will position the user's putter at the correct height dimension to impart such top spin on the ball. The opposite end of top spin platform is sufficiently thin so as to provide a generally smooth transition from the top face of front section 804 to top spin platform 808.

Optionally, and again as shown in the embodiment of FIG. 8*a*, front section may include speed control indicators 810. Speed control indicators 810 may comprise a series of individual lights that may be programmed (via microcontroller 812 in rear portion 802) to activate in series so as to provide visual feedback to the golfer of the length of their backstroke as detected by motion sensor 816 (discussed in greater detail below). Specifically, the individual lights of speed control indicators 810 are positioned so as to allow the golfer positioned over and looking down at golf putting device 100 to see the lights as they are activated in sequence, and thus provide the golfer immediate visual feedback of the length of their backstroke.

Also, a collapsible putting rail 814 may be provided and positioned adjacent front section 804 of golf putting trainer device 100. Collapsible putting rail 814 may comprise a vertical rail section 814*a* having a height dimension at least as large as a typical putter head, and two tabs 814*b* configured to either engage or sit below golf putting trainer 100 without affecting intended alignment of golf putting trainer 100. When used with golf putting trainer 100, vertical rail section 814*a* serves as a further guide for the head of the user's putter. More specifically, when in use, the user may lightly position the front end of their putter head against vertical rail section 814*a*, and keep it in contact with vertical rail section 814*a* as they proceed through their putt. This ensures that the user's putter head follows a straight path through both the back stroke and the forward stroke of their putt, thus ensuring a proper impact of the putter with the ball. Collapsible putting rail 814 is capable of folding down into a substantially flat assembly, such that it may be carried in a carrying bag along with the rest of golf putting trainer 100 in a compact storage configuration (as shown in FIG. 8*e*).

Figure 8D:
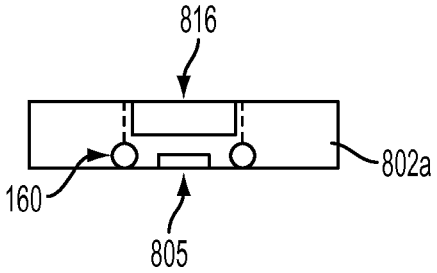
FIG. 8*d* is an end view illustration of the housing unit portion of the golf putting trainer shown in FIG. 8*a*.
Figure 8E:
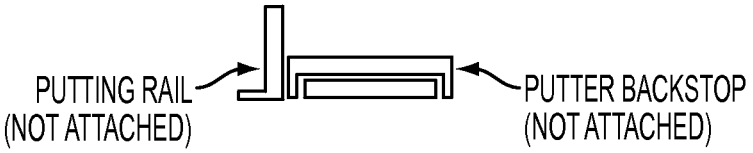
FIG. 8*e* is an end view illustration of the golf putting trainer shown in FIG. 8*a* in a compact, disassembled configuration for storage.

As shown in FIGS. 8*a* and 8*d*, golf putting trainer device 100 may also include a motion sensor 816 positioned in an upper portion of the front face of rear section 802 such that it can detect motion of the user's putter as it travels across front section 804. In a particularly preferred embodiment, motion sensor 816 may comprise an ultrasonic motion sensor (such as a Parallax Ultrasonic Range Finder), which sensor 816 is configured to measure both the distance and velocity of the user's backstroke and their follow through stroke by sending to and receiving from the golfer's putter a sound wave at set time intervals. The detected distance of the putter head from the sensor at different times is preferably used to calculate the length of the golfer's backstroke and the velocity of both the golfer's backstroke and follow through stroke. Additionally, a display 818, such as a liquid crystal display, may be provided on rear section 802 to display the distance and velocity of the user's backstroke to further assist the user in developing a consistent putt of proper form. For example, display 818 may show the golfer's backstroke length (e.g., in inches) and a measurement of their backstroke and follow through stroke velocities relative to one another. This information may also be transmitted such as through use of a BlueTooth transmission module in microcontroller 112, to a software application (such as a mobile software application installed on the golfer's cell phone or similar portable data device). Such software application may be configured to store the golfer's putts from each practice session so that the golfer may track their improvement and mark consistency for various putt lengths.

More particularly, the golfer may link golf putting trainer device 100 with their cell phone or other portable data device through a BlueTooth connection in trainer device 100, and the mobile software on the user's portable data device will recognize the trainer device 100. The software application will record the user's backstroke length and putter path velocities for each putt. That data is stored by the software application so that the user may reference each putt length for consistent practicing and enhanced improvement. Preferably, golfing professionals may also interact with the software application to create a profile for themselves, and may include in that profile various putting theory techniques, theory demonstrations, putting drills, etc. A golfer that uses trainer device 100 may purchase access to such an online profile for a fee, the revenue from which may then be distributed between some combination of the golfing professional and an operator of the software application.

One or more additional toggle switches 819 may be provided to selectively power display 818 and sensor 816.

As shown in the configuration of FIGS. 8*a* through 8*d*, golf putting trainer device 100 configured according to such embodiment encourages the user to stand over the ball (so as to see all of the visual aid devices incorporated in golf putting trainer device 100), and assists the user in a proper putting stance with two alignment lasers, which can be toggled on or off to test the golfer's improved visualization and alignment accuracy. Backstop 140 is configured to restrict the golfer's backstroke, thus forcing an equal follow through stroke. Once comfortable, the golfer can test his progress using motion sensor 816, which measure both the distance and velocity of the golfer's backstroke as compared to the follow through stroke. Stroke consistency is addressed by providing visual stroke center line 618 and 90 degree putting rail 814 to teach a straight back and forth technique. Finally, detachable top spin platform 808 is used to increase user comfort and ensure proper ball impact, forcing proper top spin. Such combination of features significantly improve upon previously known putting trainer devices, as they simultaneously address the combined key issues that a golfer must concentrate on in order to perfect their putt.

Next, as shown in FIGS. 1 and 3 (but envisaged on each embodiment of the invention), base 110 may also include studs 121 extending downward from bottom face 120 of base 110. Studs 121 are preferably removable from base 110, being joined thereto through use of a threaded, screw-type attachment, a snap, or any other configuration allowing for the ready attachment and removal of studs 121 from base 110. Studs 121 may likewise comprise golf tees that may be slid into a keyhole type opening for each stud provided on the bottom face 120 of base 110. Given these configurations, when putting trainer device 100 is intended for use outdoors, studs 121 may be applied such that they may be pushed into the ground so as to lock the position of putter training device 100 in place. Likewise, when putting trainer device 100 is intended for use indoors, studs 121 may be removed so that base 110 may rest flat on a flooring surface.

In use, and with respect again to FIG. 1, a golfer will first position a golf ball 200 within approximately one inch of front face 114 of base 110. Then, based upon the intended travel distance of the put, the golfer will position backstop 140 at the desired location so as to achieve the intended distance. Aligning themselves over putting trainer device 100, the golfer will then draw their putter back over the alignment line (e.g., line 618 of FIGS. 6 and 8) until impacting backstop 140, and then swing the putter forward toward ball 200 along such alignment line. When the putter impacts ball 200, the height of base 110 will cause the putter to impact ball 200 in its upper hemisphere, thus creating the much-desired topspin in the ball as it travels towards the hole. Likewise (and assuming that the golfer has turned on light projection devices 160), the golfer will strive to keep the club aligned to carry out a straight stroke sufficient to cause the ball 200 to remain within the visual path created by light beams 180 projected onto the ground in front of putting trainer device 100. Through the repetitive, controlled practice of putting strokes using this method, it is intended that the golfer will be able to develop the feel and mental visualization necessary to improve their putting performance.

Having now fully set forth the preferred embodiments and certain modifications of the concept underlying the present invention, various other embodiments as well as certain variations and modifications of the embodiments herein shown and described will obviously occur to those skilled in the art upon becoming familiar with said underlying concept. It should be understood, therefore, that the invention may be practiced otherwise than as specifically set forth herein.

The invention claimed is:

1. A golf putting training device, comprising:

a first substantially flat and elongated structure having a height, a length, a width, and a longitudinal axis;

a first vertical structure having a vertical axis;

said flat and elongated structure comprising a plurality of recesses configured to receive an end of said first vertical structure, said recesses spaced along the longitudinal axis to allow different lengths of a golfer's putting backswing, each different backswing length corresponding to a different put distance;

the height of said flat and elongated structure no greater than 50% of the height of a standard golf ball; and a backswing speed control indicator system comprising a plurality of lights aligned along or adjacent to said longitudinal axis of said elongated structure, and a motion sensor, said motion sensor configured to detect movement of a golf putter along said longitudinal axis of said elongated structure, and said plurality of lights configured to illuminate to illustrate a backswing distance as detected by said motion sensor.

2. A golf putting device according to claim 1, further comprising a distance scale printed on a top surface of said elongated structure, said distance scale corresponding to predicted putting distances for different backswing lengths corresponding in turn to different vertical structure positions along said elongated structure.

3. A golf putting device according to claim 1, further comprising a light beam projection device configured to project a laser beam along or adjacent to a predicted path of a golf ball putted from said golf putting device.

4. A golf putting device according to claim 1, further comprising projections from a bottom surface of said elongated structure configured to engage a ground surface during use to prevent sliding of the device.

5. A golf putting device according to claim 1, further comprising a sound generating device configured to activate a sound when a golf putter contacts said vertical structure to alert a golfer when the golf putter has reached a maximum backswing for a selected putt distance.

6. A golf putting device according to claim 1, further comprising a sloped top spin platform configured to be removably attached to an end of the elongated structure.

7. A golf putting device according to claim 1, further comprising a putting rail configured to be removably attached to a side of said elongated structure.

8. A golf putting device according to claim 1, further comprising a second elongated structure configured to contain a controller and battery system for said backswing speed control indicator system.

9. A golf putting training device, comprising:

a first substantially flat and elongated structure having a height, a length, a width, and a longitudinal axis;

a first vertical structure having a vertical axis, a bottom portion at a lower end of said vertical axis, and a top portion at an upper end of said vertical axis;

said first vertical structure being removably and slidably mounted on said substantially flat and elongated structure; and a backswing speed control indicator system comprising a plurality of lights aligned along or adjacent to said longitudinal axis of said elongated structure, and a motion sensor, said motion sensor configured to detect movement of a golf putter along said longitudinal axis of said elongated structure, and said plurality of lights configured to illuminate to illustrate a backswing distance as detected by said motion sensor.

10. A golf putting device according to claim 9, further comprising a distance scale printed on a top surface of said elongated structure, said distance scale corresponding to predicted putting distances for different backswing lengths corresponding in turn to different vertical structure positions along said elongated structure.

11. A golf putting device according to claim 9, further comprising a light beam projection device configured to project a laser beam along or adjacent to a predicted path of a golf ball putted from said golf putting device.

12. A golf putting device according to claim 9, further comprising projections from a bottom surface of said elongated structure configured to engage a ground surface during use to prevent sliding of the device.

13. A golf putting device according to claim 9, further comprising a sound generating device configured to activate a sound when a golf putter contacts said vertical structure to alert a golfer when the golf putter has reached a maximum backswing for a selected putt distance.

14. A golf putting device according to claim 9, further comprising a sloped top spin platform configured to be removably attached to an end of the elongated structure.

15. A golf putting device according to claim 9, further comprising a putting rail configured to be removably attached to a side of said elongated structure.

16. A golf putting device according to claim 9, further comprising a second elongated structure configured to contain a controller and battery system for said backswing speed control indicator system.

17. A golf putting training device, comprising:

a first substantially flat and elongated structure having a height, a length, a width, a front end, a back end, and a longitudinal axis extending from said back end to said front end;

a first vertical structure having a vertical axis, a bottom portion at a lower end of said vertical axis, and a top portion at an upper end of said vertical axis;

said first vertical structure being removably and slidably mounted on said substantially flat and elongated structure; and a light beam projection device projecting an image outward from said front end of said flat and elongated structure and parallel to said longitudinal axis, said image displaying a predicted path of a golf ball putted from said golf putting device.

18. A golf putting device according to claim 17, further comprising a distance scale printed on a top surface of said elongated structure, said distance scale corresponding to predicted putting distances for different backswing lengths corresponding in turn to different vertical structure positions along said elongated structure.

19. A golf putting device according to claim 17, further comprising projections from a bottom surface of said elongated structure configured to engage a ground surface during use to prevent sliding of the device.

20. A golf putting device according to claim 17, further comprising a sound generating device configured to activate a sound when a golf putter contacts said vertical structure to alert a golfer when the golf putter has reached a maximum backswing for a selected putt distance.

21. A golf putting device according to claim 17, further comprising a sloped top spin platform configured to be removably attached to an end of the elongated structure.

22. A golf putting device according to claim 17, further comprising a putting rail configured to be removably attached to a side of said elongated structure.

23. A golf putting device according to claim 17, further comprising a backswing speed control indicator system comprising a plurality of lights aligned along or adjacent to said longitudinal axis of said elongated structure, and a motion sensor, said motion sensor configured to detect movement of a golf putter along said longitudinal axis of said elongated structure, and said plurality of lights configured to illuminate to illustrate a backswing distance as detected by said motion sensor.

24. A golf putting device according to claim 23, further comprising a second elongated structure configured to contain a controller and battery system for said backswing speed control indicator system.

* * * * *